US006901705B1

(12) United States Patent
Park

(10) Patent No.: US 6,901,705 B1
(45) Date of Patent: Jun. 7, 2005

(54) GUIDE RAIL FOR A SLIDING CLOSURE HAVING A GUIDE GROOVE WITH A GROOVE FILLING DEVICE

(76) Inventor: Myung-shin Park, 16-3 Gamjung-dong, Kimpo-si, Kyungki-do 415-010 (KR)

( * ) Notice: Subject to any disclaimer, the term of this patent is extended or adjusted under 35 U.S.C. 154(b) by 66 days.

(21) Appl. No.: 10/070,980

(22) PCT Filed: Sep. 8, 2000

(86) PCT No.: PCT/KR00/01026

§ 371 (c)(1),
(2), (4) Date: Mar. 7, 2002

(87) PCT Pub. No.: WO01/20115

PCT Pub. Date: Mar. 22, 2001

(30) Foreign Application Priority Data

Sep. 10, 1999 (KR) ..... 1999-38490

(51) Int. Cl.[7] ..... E05D 15/06

(52) U.S. Cl. ..... 49/410; 49/63; 49/425; 49/414; 49/428

(58) Field of Search ..... 16/91, 100, 45 R, 16/105; 49/61, 62, 63, 425, 125, 408, 410, 409, 411, 428, 414, 420, 476.1, 484.1; 52/207, 202

(56) References Cited

U.S. PATENT DOCUMENTS 134,698 A * 1/1873 Otis ..... 187/408
2,078,811 A * 4/1937 Rouse ..... 238/6
2,151,033 A * 3/1939 Jones ..... 160/40
3,217,454 A * 11/1965 Xavier ..... 52/204.593
3,436,864 A * 4/1969 Halpern ..... 49/425
3,785,090 A * 1/1974 MacGillis ..... 49/425
3,810,330 A * 5/1974 Daggy ..... 49/127
3,855,732 A * 12/1974 Sheaf ..... 49/425
3,984,954 A * 10/1976 Takeda ..... 52/202
4,051,633 A * 10/1977 Voegele, Jr. ..... 49/411
4,398,373 A * 8/1983 Mancuso ..... 49/425
4,599,836 A * 7/1986 Melcher ..... 52/202
4,633,616 A * 1/1987 Giguere ..... 49/425
4,733,499 A * 3/1988 Guddas ..... 49/404
4,800,619 A * 1/1989 Hudak ..... 16/95 R
4,868,935 A * 9/1989 Van Weelden ..... 4/610
5,488,803 A * 2/1996 George ..... 49/425
5,598,665 A * 2/1997 Guddas ..... 49/404
5,836,111 A * 11/1998 Tak ..... 49/425
5,884,361 A * 3/1999 Richardson et al. ..... 16/100
5,927,017 A * 7/1999 Jacobs et al. ..... 49/410
6,026,612 A * 2/2000 Strassel et al. ..... 49/425

* cited by examiner

*Primary Examiner*—Gregory J. Strimbu
(74) *Attorney, Agent, or Firm*—Smith-Hill and Bedell

(57) ABSTRACT

A sliding closure system comprising a frame and at least one slidable leaf member. The frame has a frame upper member and a frame lower member each being formed with at least one longitudinal groove. A groove filling device comprising an elastic member and an elongate filling member is disposed in the longitudinal groove of the frame lower member. A lower member of the slidable leaf member includes a height control roller having a projection that is received in the longitudinal groove of the frame lower member for guiding the slidable leaf member longitudinally of the frame lower member.

17 Claims, 18 Drawing Sheets

GUIDE RAIL FOR A SLIDING CLOSURE HAVING A GUIDE GROOVE WITH A GROOVE FILLING DEVICE

A sliding door system acts as the same with a sliding window system in the specification, and thus description of the window-includes description of the door.

TECHNICAL FIELD

The present invention relates to a sliding window and door system, which cuts off external dust, rainwater, air, noise, and heat by mounting a window frame provided with upper, lower, left, and right members assembled in a rectangular shape on a wall and mounting a window leaf provided with upper, lower, left, and right members assembled in a rectangular shape in the window frame.

BACKGROUND ART

A related art window and door system will be described with reference to the accompanying drawings.

FIG. 1 is a front view showing a window and door to which a related art window and door system is applied. FIG. 2 is a sectional view taken along line A—A of FIG. 1.

The related art window and door system includes a window frame lower member 1 and window leaf lower members 2*a* and 2*b*. The window frame lower member 1 is provided with exposed rails 11. The window leaf lower members 2*a* and 2*b* are provided with rollers 21 mounted and arranged on the rails 11, and are guided by mohair members 22 and the rails 11 to open and close.

In the aforementioned related art window and door system, since the window leaf is opened and closed depending on the exposed rails, rainwater is drained out between the rails. For this reason, air tightness, water tightness, and thermal insulation cannot be improved. This could lead to low energy efficiency.

Furthermore, since the window leaf is inserted into the window frame, it is simple to assembly and disassembly the window leaf. However, it is likely that the window leaf is detached due to strong wind or manipulation. Accordingly, when the window leaf is used in a multistoried building, the window leaf is likely to be fallen down by being detached from the window frame. This causes dangerous situations.

Moreover, since stains of dust and rainwater piled between the rails are not easily removed, cleaning is difficult. If the piled dust is left uncleaned, the piled dust is raised when opening and closing the window leaf, thereby causing the air to be impure. It is therefore difficult to maintain a clean state. It a drainage outlet for rainwater between the rails is blocked by the dust and the like, or in case of a heavy rain accompanied by strong wind, damage may occur due to the rainwater. Also, an uneven lower structure has limitation in improving the appearance of the window and door system.

DISCLOSURE OF THE INVENTION

Accordingly, the present invention is directed to a sliding window and door system that substantially obviate one or more of the problems due to limitations and disadvantages of the related art.

An object of the present invention is to provide a sliding window and door system of filling a rail having an even structure to remarkably improve air tightness, water tightness, and thermal insulation.

Another object of the present invention is to provide a sliding window and door system, which is likely to maintain a cleaning state and prevents a window leaf from being detached, thereby ensuring stability.

Other object of the present invention is to provide a sliding window and door system, which is likely to improve appearance depending on taste and functions, thereby providing high quality.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a sliding window and door system according to the present invention includes: a window frame (or door frame) lower member provided with surface members and rail filling device grooves in a window frame (or door frame) base member, for inserting rail filling devices into the rail filling device grooves, the rail filling devices including a rail filling device base member corresponding to the rail filling device grooves, a rail filling member, and a roller supporting member; window leaf (or door leaf) lower members for driving height control rollers provided with projections to correspond to the rail filling systems by inserting the control rollers into roller grooves formed in window leaf (or door leaf) base members to be guided by the projections and the rail filling devices, and for mounting gaskets to maintain air tightness between the window leaf base members and the surface members; a window frame (or door frame) upper member having a window frame (or door frame) base member similar to the window frame base member of the window frame lower member, expect that the rail filling device grooves correspond to supporting grooves to which upper insertion portions of window leaf (or door leaf) upper members are inserted; and the window leaf upper members provided with control rollers mounted in the upper insertion portions to prevent the window leaf from being detached, thereby forming an even structure.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings.

"Outdoor" and "indoor" which will now be described in sectional views respectively mean "left side" and "right side" on the drawings.

Figure 1:
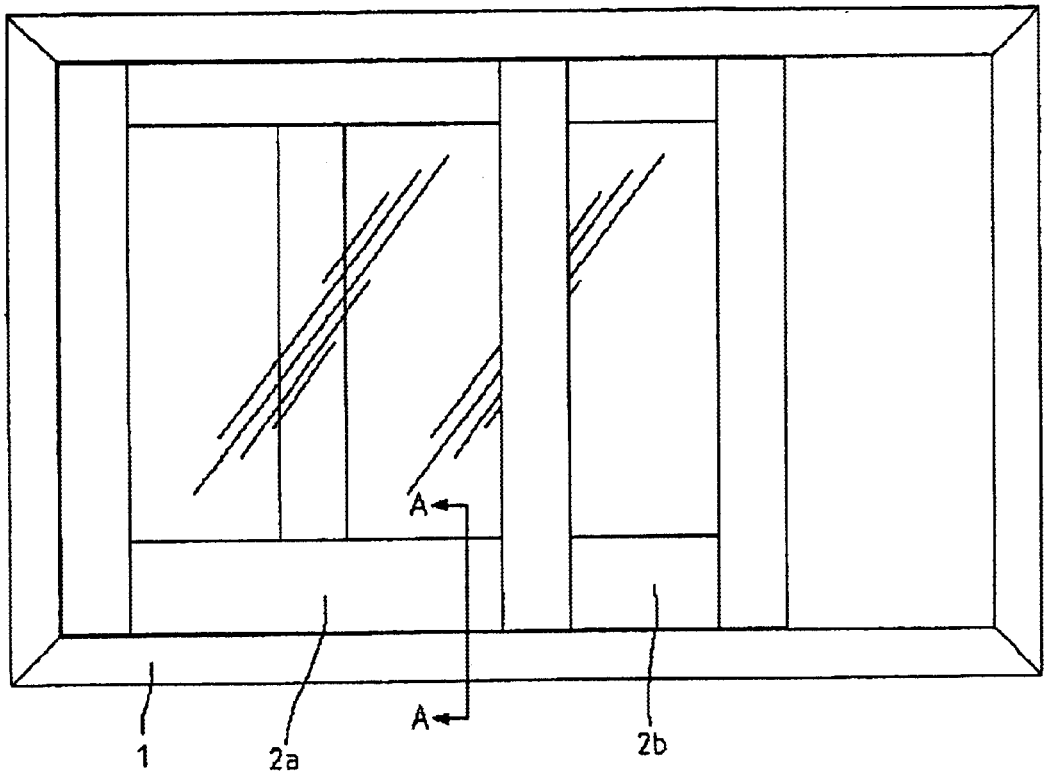
FIG. 1 (Prior Art)
FIG. 1 is a front view showing a window and door to which a related art window and door system is applied.
Figure 2:
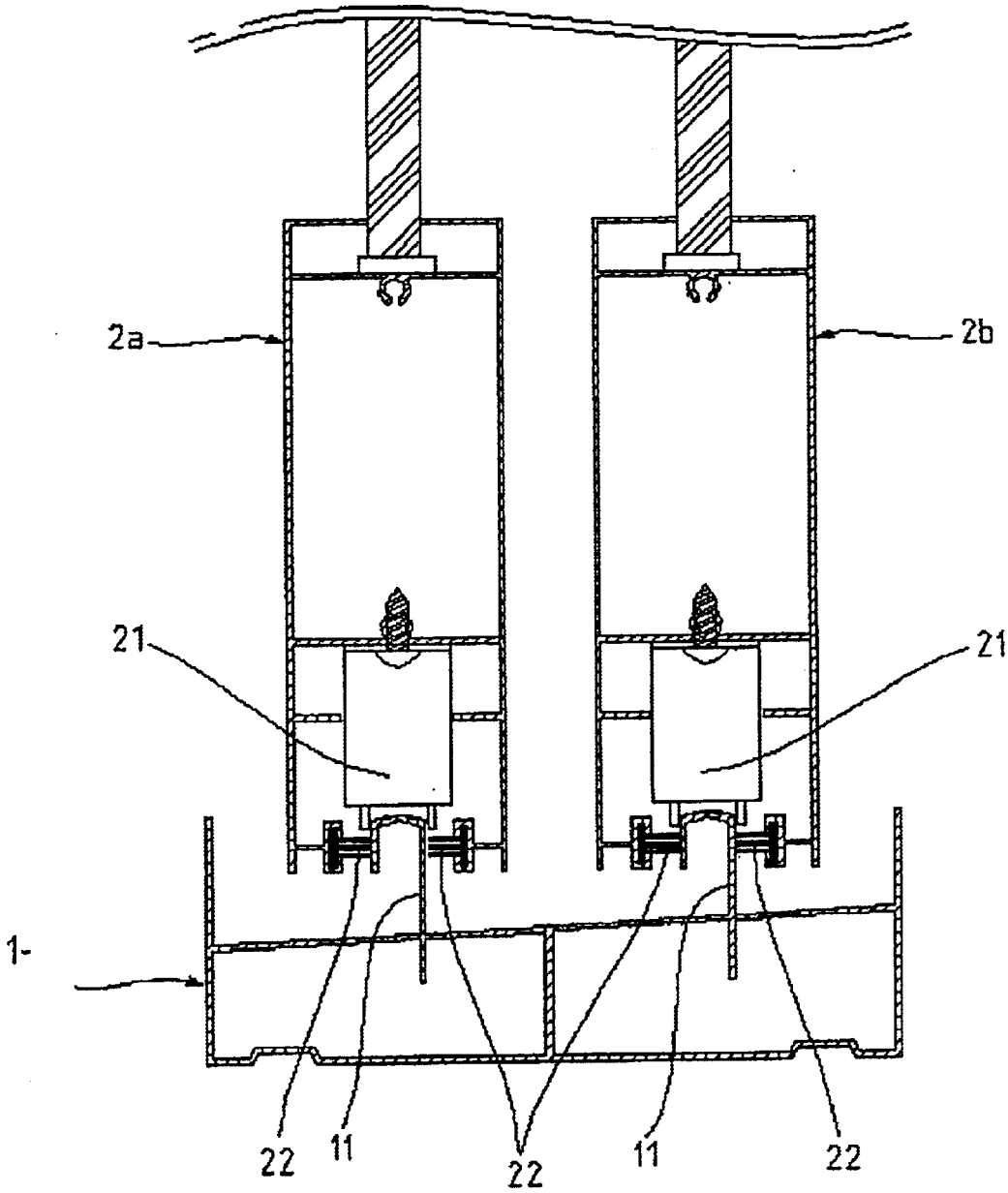
FIG. 2 (Prior Art)
FIG. 2 is a sectional view taken along line A—A of FIG. 1.
Figure 3:
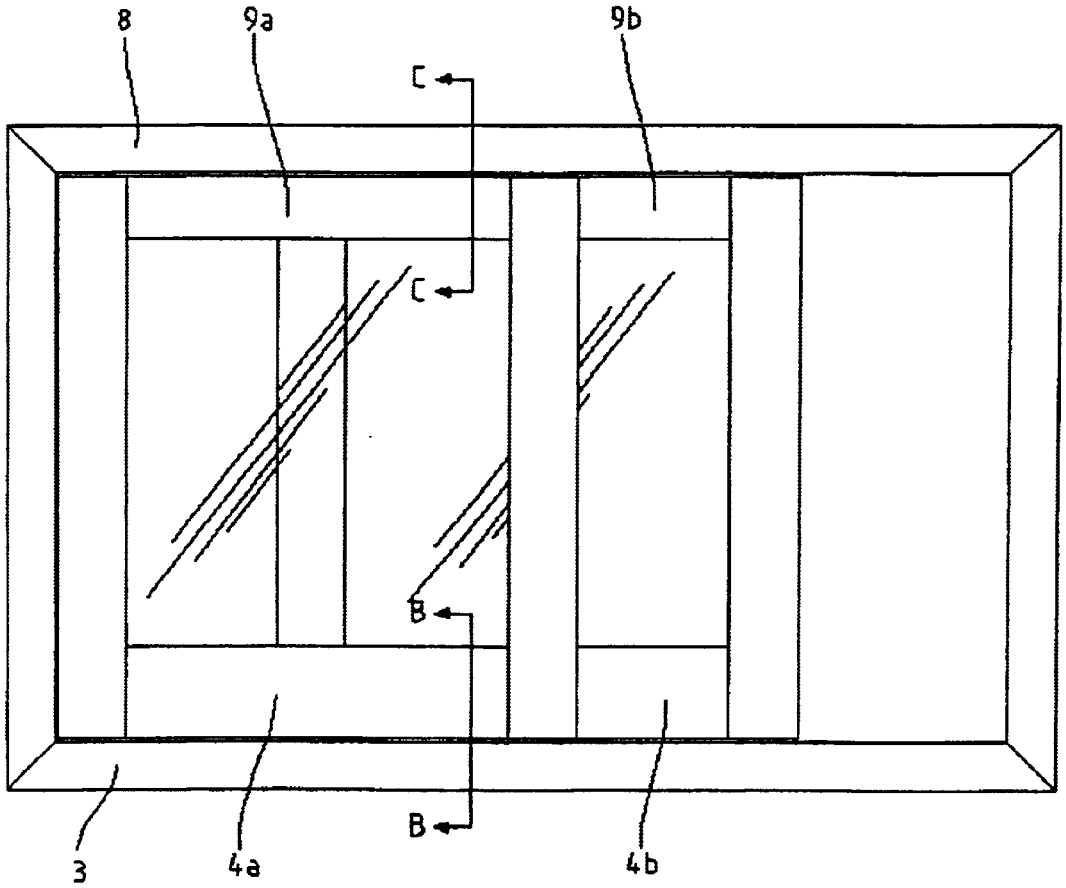
FIG. 3 is a front view showing a window and door to which a window and door system according to the present invention is applied.

FIG. 3 is a front view showing a window and door viewed from an outside, to which a window and door system according to the present invention is applied. Sectional views taken along lines B—B and C—C are shown in FIGS. 4, 6, 7, 8, 10, and 11.

Figure 4:
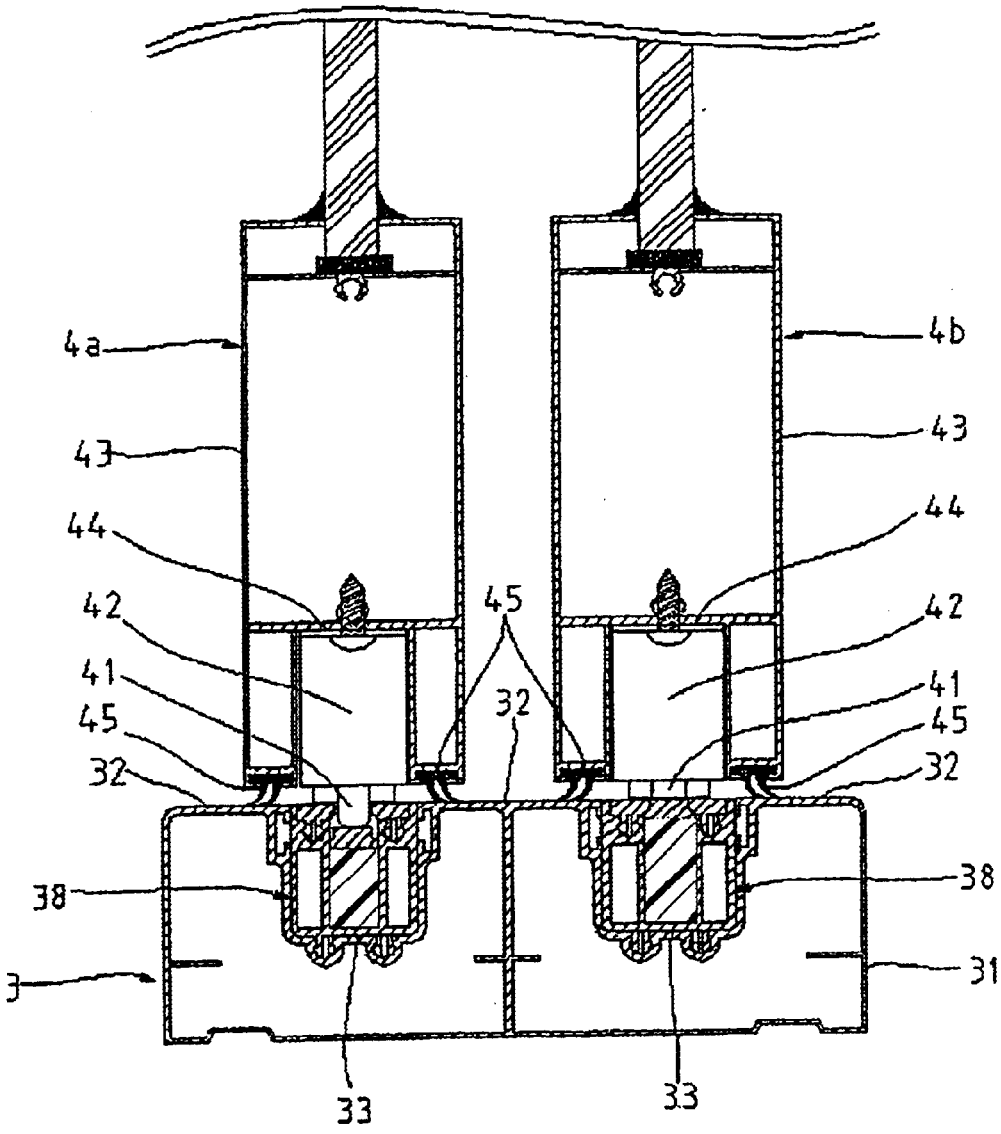
FIG. 4 is a sectional view taken along line B—B of FIG. 3.
Figure 6:
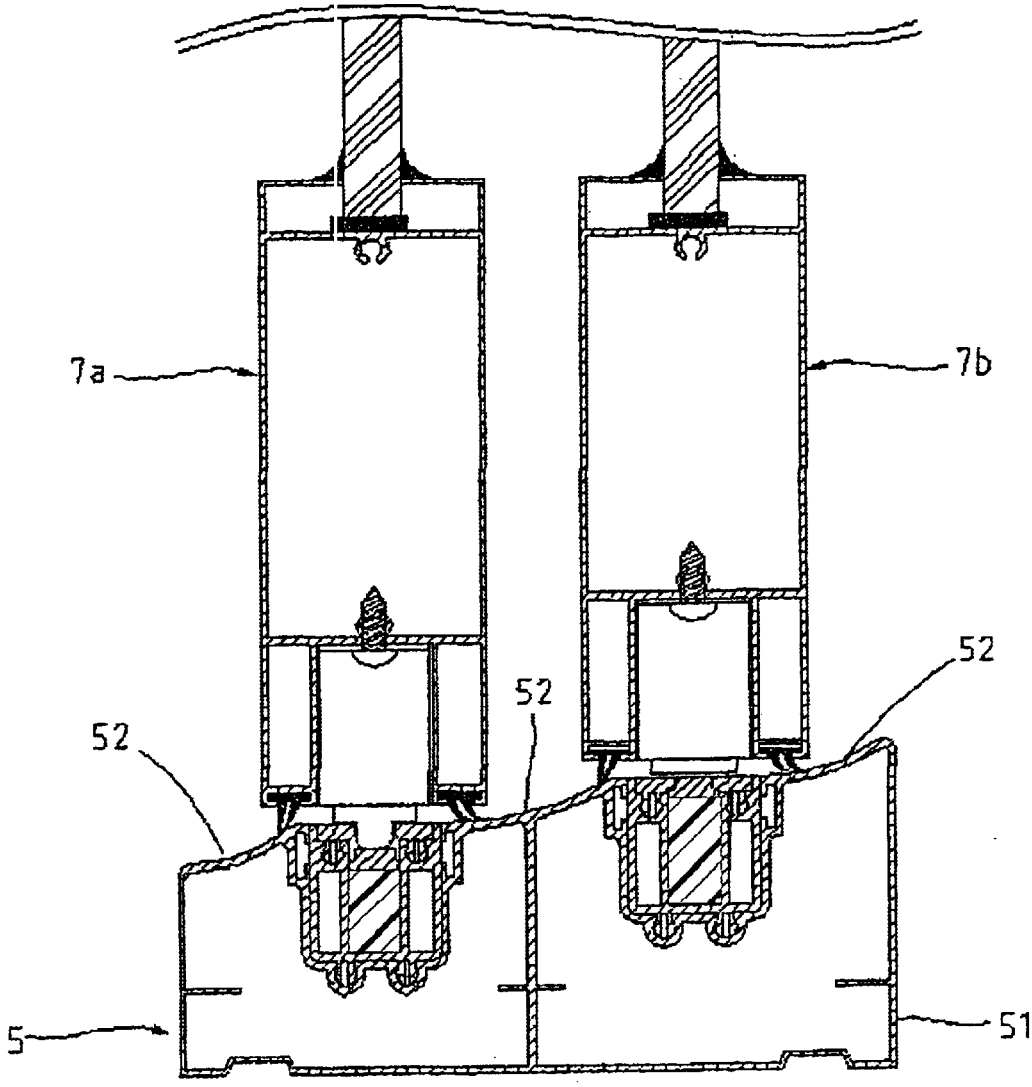
FIG. 6 shows another embodiment of FIG. 4.
Figure 7:
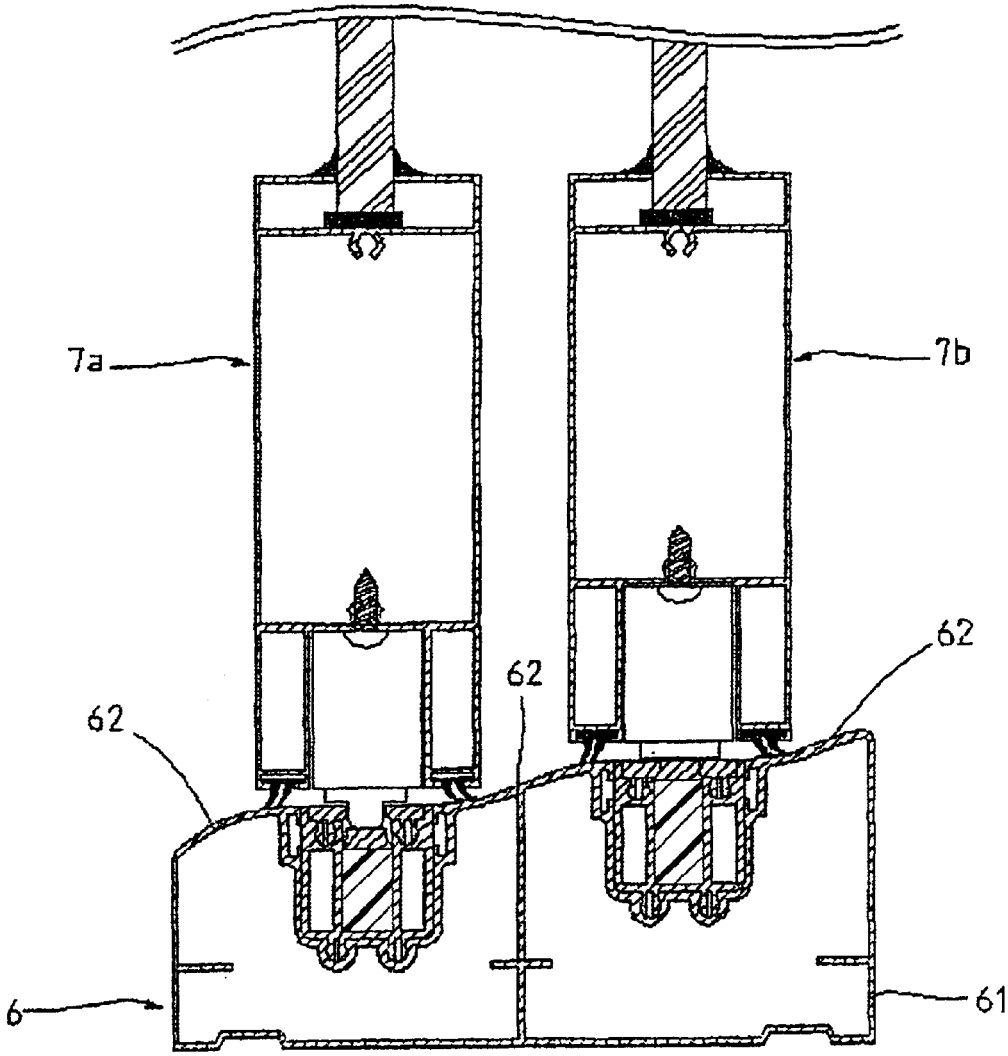
FIG. 7 shows other embodiment of FIG. 4.

FIGS. 4, 6, and 7 are sectional views taken along line B—B of FIG. 3, in which main elements of a sliding window and door system are shown.

Figure 5:
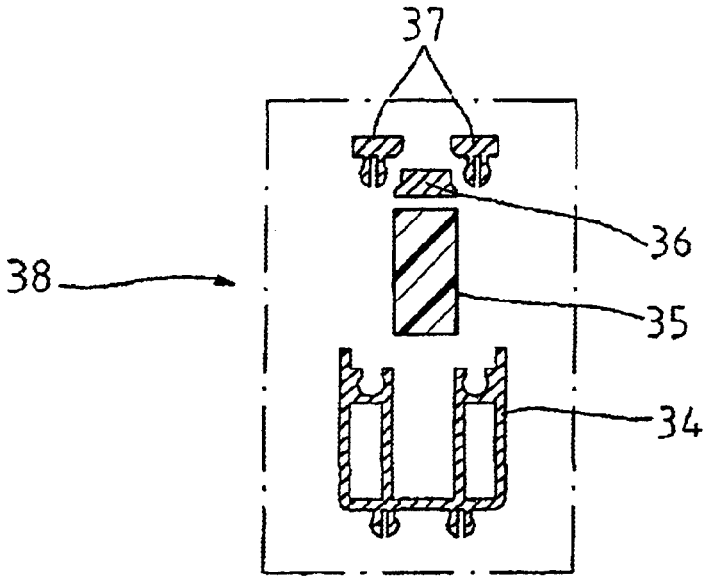
FIG. 5 is a schematic view showing a rail filling system of FIG. 4.

Referring to FIG. 4, a window frame lower member 3 includes a window frame base member 31, surface members 32, rail filling device grooves 33, and rail filling devices 38. The rail filling device grooves 33 for installation of the rail filling devices 38 and the surface members 32 are provided in the window frame base member 31. The rail filling device 38 has a rail filling device base member 34 corresponding to the rail filling device grooves 33, an elastic member 35, a rail filling member 36, and a roller supporting member 37 is inserted into each rail filling device groove 33 provided in the window frame base member 31. An even structure of the window frame lower member 3 is constructed as above (see a schematic view of the rail filling system of FIG. 5).

The construction of window leaf lower members 4*a* and 4*b* will now be described. Height control rollers 42 provided with projections 41 to correspond to the rail filling devices 38 are inserted into roller grooves 44 provided in respective window leaf base members 43, so that the rollers 42 are guided and driven by the projections 41 and the rail filling devices 38. To maintain air tightness between the window leaf base members 43 and the surface members 32, gaskets 45 are mounted. Thus, the window leaf lower members 4*a* and 4*b* can correspond to the window frame lower member 3.

The operation and driving principles of the height control rollers 42 provided with the projections 41 of the window leaf lower members 4*a* and 4*b* and the rail filling devices 38 of the window frame lower member 3 will be described below.

The projection 41 of the roller 42 pushes the rail filling member 36 of the rail filling device 38 and contracts the elastic member 35. Thus, the projection 41 is inserted into the groove provided between the roller supporting members 37. The roller 42 is guided into the groove between the roller supporting members 37 and then driven. If the rollers 42 are driven, the contracted elastic member 35 is returned to its original state and the rail filling member 36 fills the groove between the roller supporting members 37 to form an even surface.

In FIGS. 6 and 7, to form the even structure of FIG. 4 in a frame type structure, window frame lower members 5 and 6 include surface members 52 and 62 provided in window frame base members 51 and 61 in a frame type. In this case, rainwater is smoothly guided to the outside.

Heights of window leaf lower members 7*a* and 7*b* are controlled to correspond to the window frame lower members 5 and 6.

Figure 8:
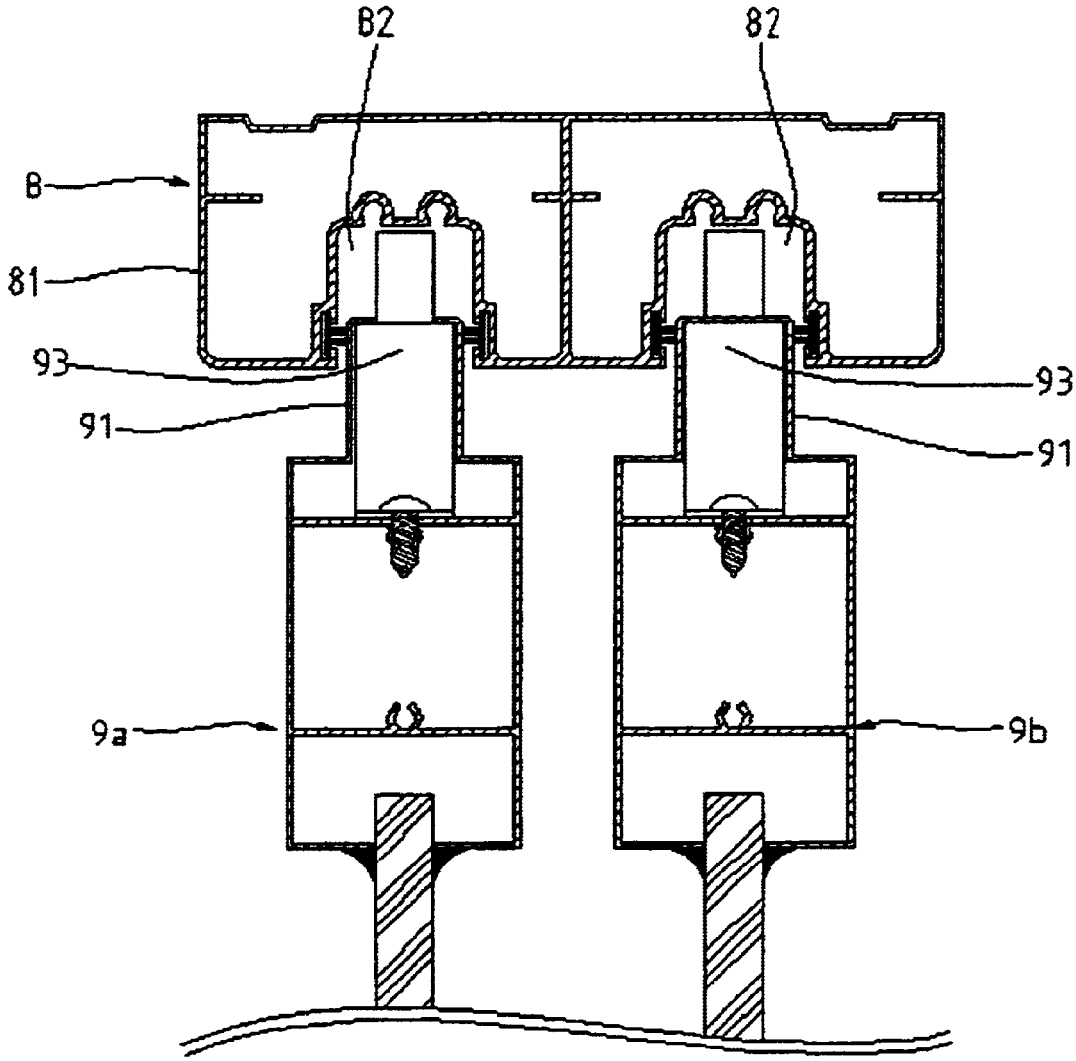
FIG. 8 is a sectional view taken along line C—C of FIG. 3.
Figure 10:
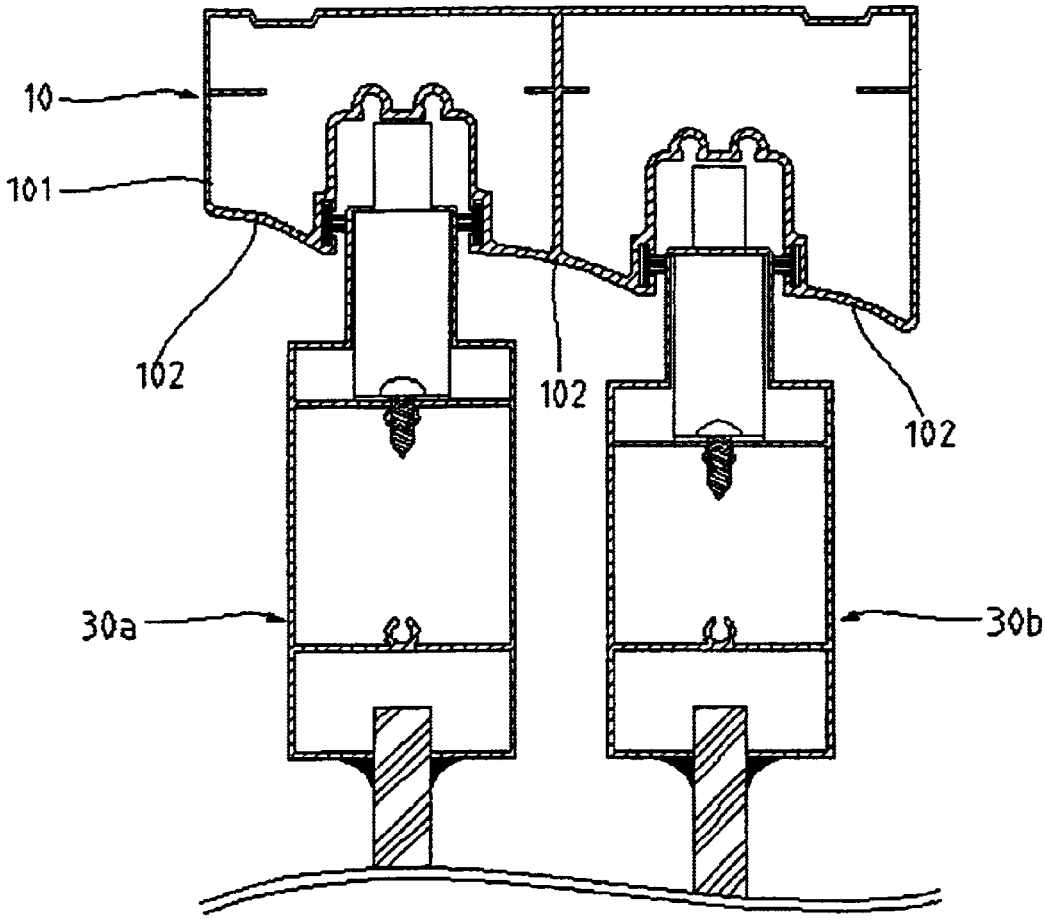
FIG. 10 shows another embodiment of FIG. 8.
Figure 11:
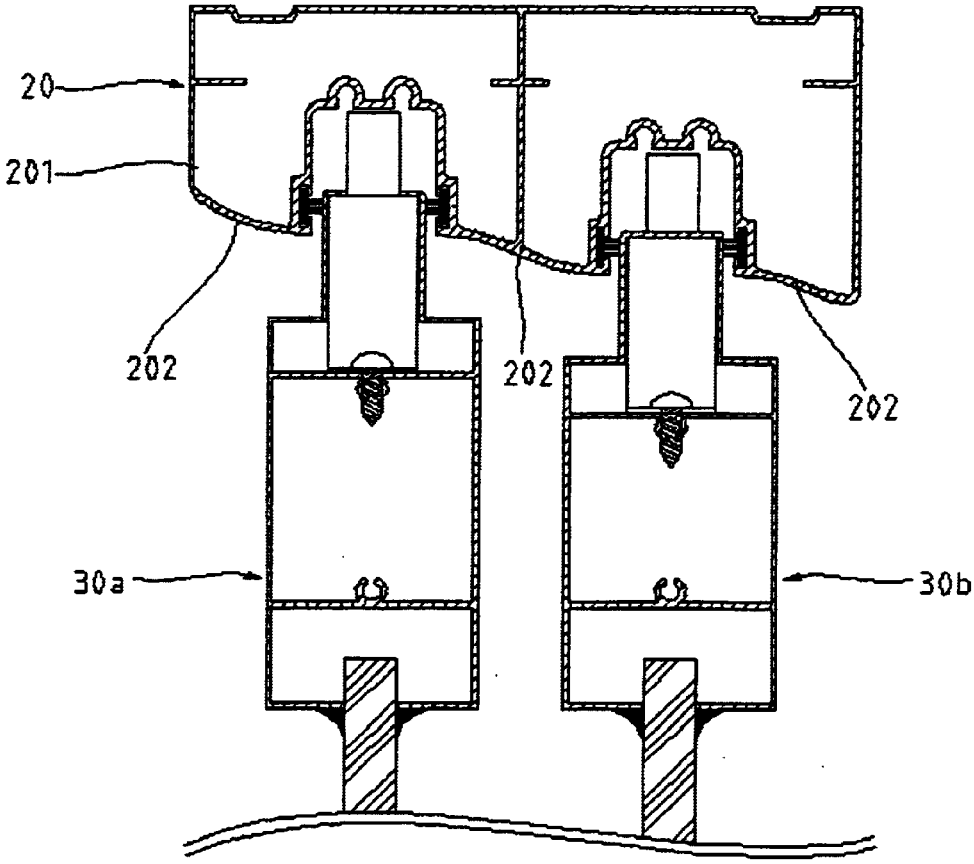
FIG. 11 shows other embodiment of FIG. 8.

FIGS. 8, 10, and 11 are sectional views taken along line C—C of FIG. 3, in which main elements of a sliding window and door system are shown.

In FIG. 8, a window frame base member 81 of a window frame upper member 8 is similar to the window frame base member 31 of the window frame lower member, but is mounted in an upper side of the window and door system. In this case, the rail filling device grooves 33 correspond to supporting grooves 82, to which upper insertion portions 91 of window leaf upper members 9*a* and 9*b* are inserted.

Figure 9:
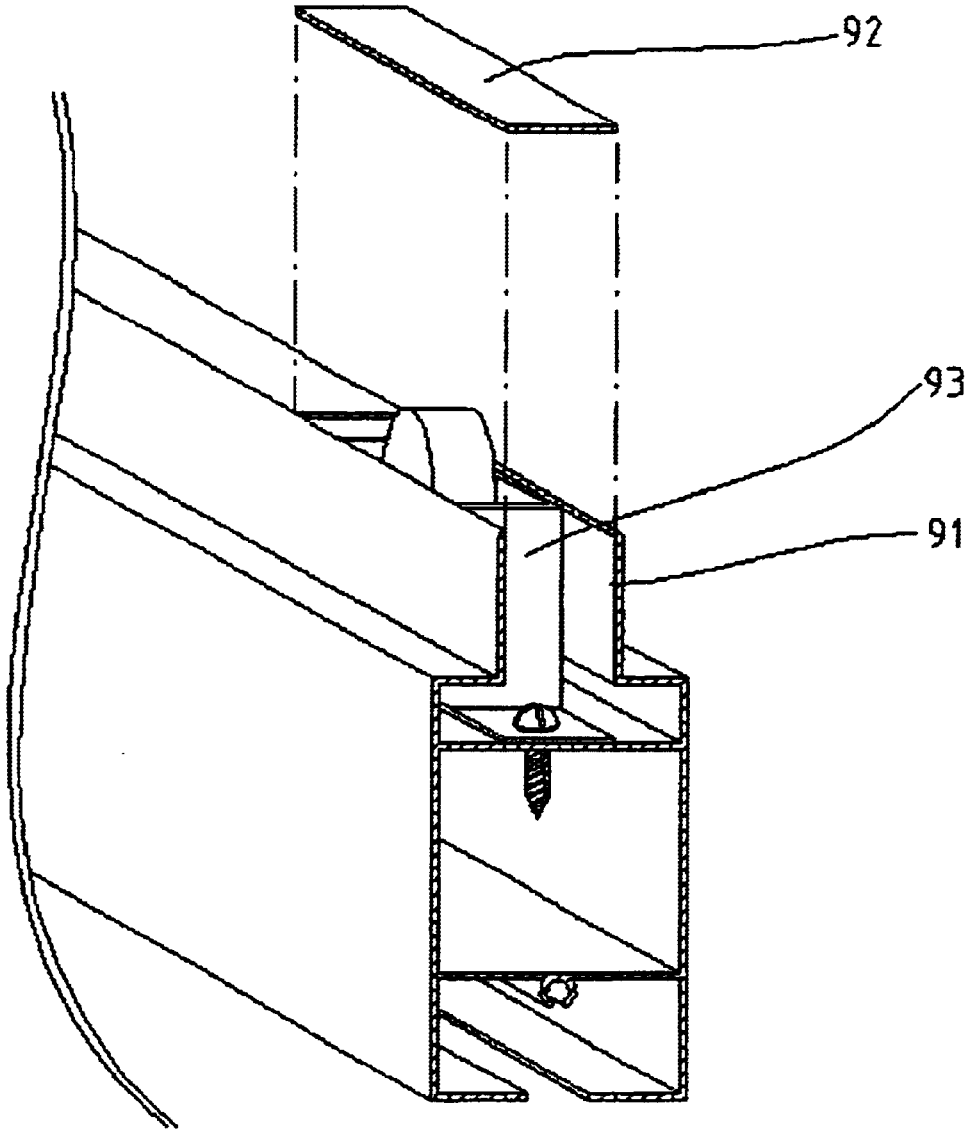
FIG. 9 is an installation view of a detachment prevention roller of FIG. 8.

The window leaf upper members 9*a* and 9*b* include the upper insertion portions 91 to correspond to the window frame upper member 8. Control rollers 93 for preventing the window leaf from being detached by cutting a cutting portion 92 of the upper insertion portions 91 are mounted in the window leaf upper members 9*a* and 9*b* (see installation view of FIG. 9).

The construction of preventing the window leaf from being detached will be described below.

For installation of the upper insertion portions 91, the height of the control rollers 93 is downwardly controlled. The upper insertion portions 91 are deeply inserted into the supporting grooves 82 to facilitate installation of the lower member. After installation of the lower member, an inner space formed between the upper insertion portions 91 and the supporting grooves 82 is finished up by upwardly controlling the height of the control rollers 93.

FIG. 8 shows an installation state, in which the window leaf upper members 9*a* and 9*b* cannot be detached due to the control rollers 93.

Since the window frame base member 81 of the window frame upper member 8 is equivalent to the window frame base member 31 of the window frame lower member 3, the even structure can be constructed in a frame type structure.

In FIGS. 10 and 11, window frame upper members 10 and 20 of a frame type structure and window leaf upper members 30*a* and 30*b* are shown. The height of the window leaf upper members 30*a* and 30*b* is controlled to correspond to the window frame upper members 10 and 20.

Figure 12:
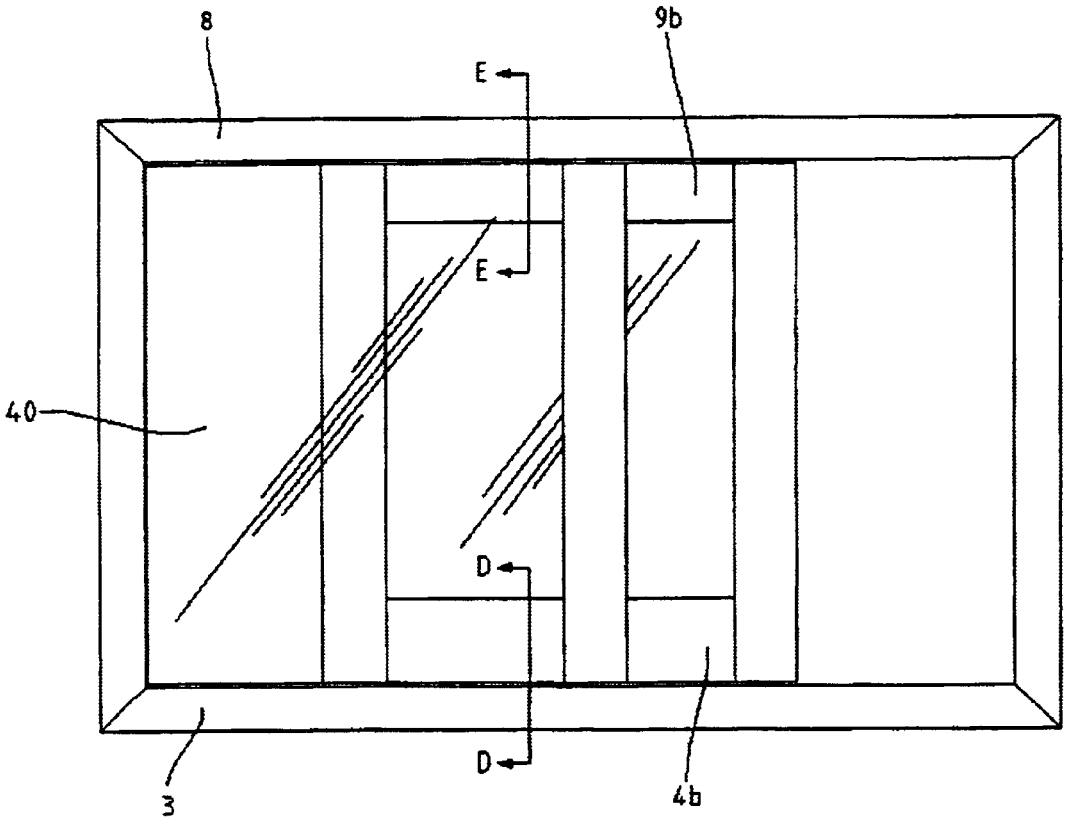
FIG. 12 is a front view showing a window and door viewed from an outside, in which an outdoor window leaf (or door leaf) is replaced with a fixed window (or fixed door)
Figure 13:
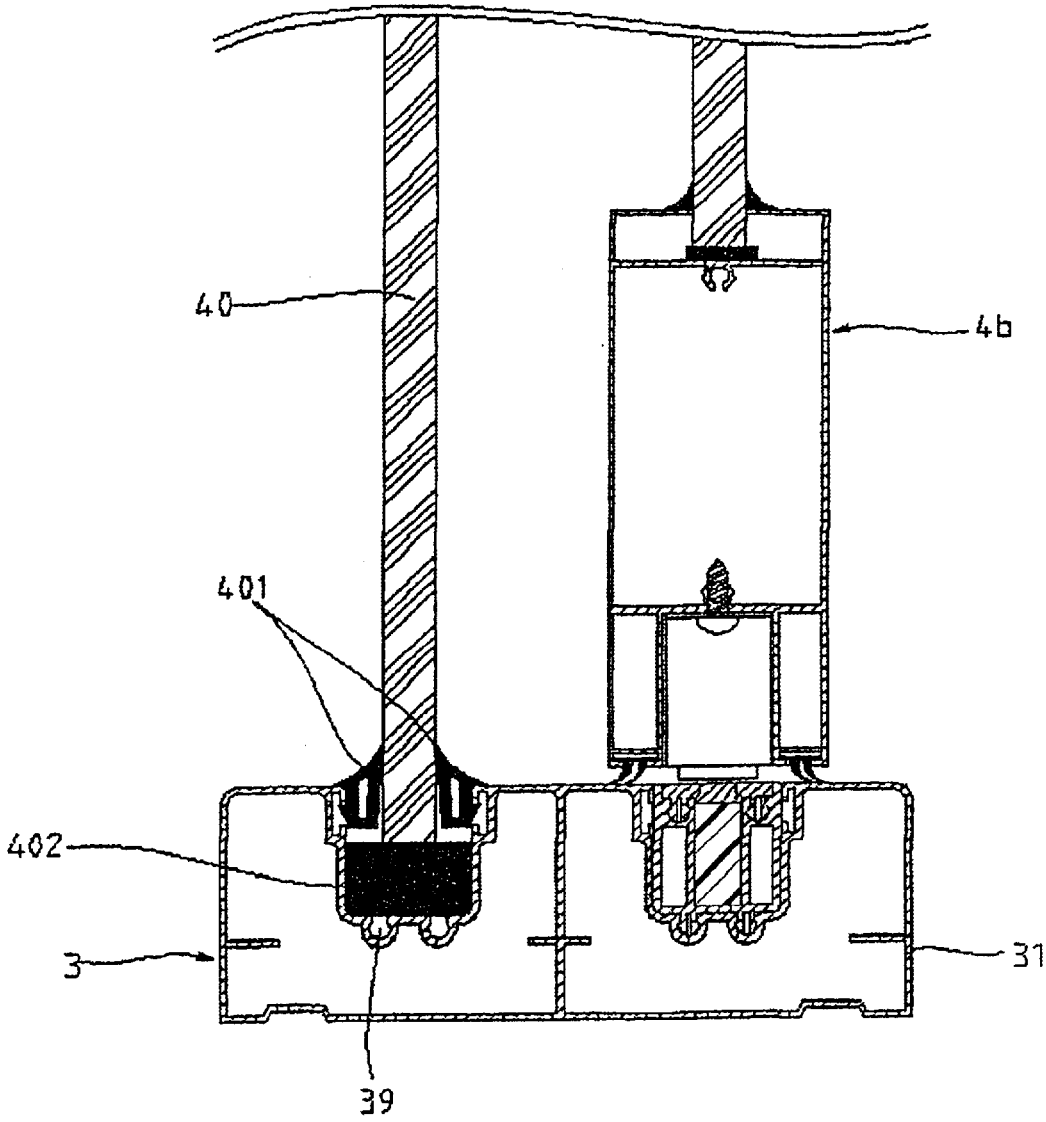
FIG. 13 is a sectional view taken along line D—D of FIG. 12.
Figure 14:
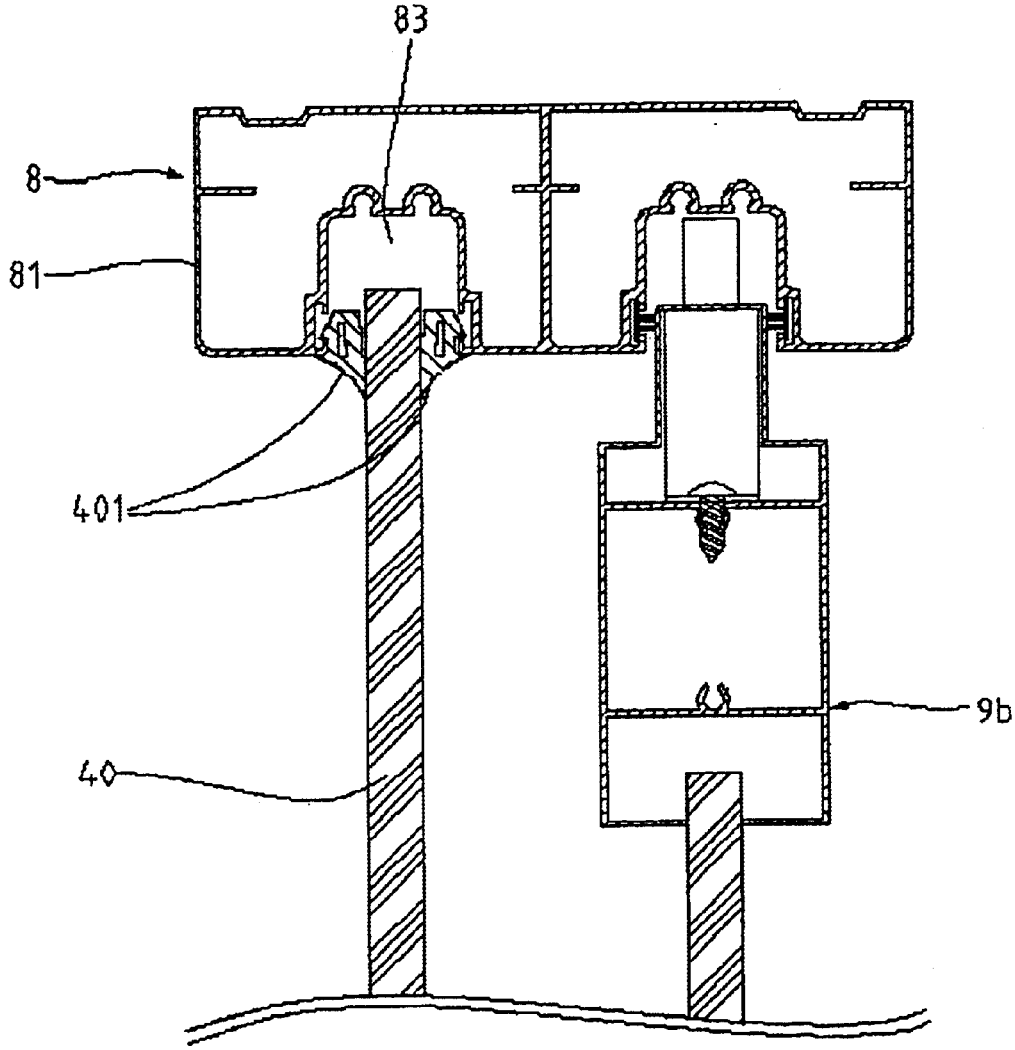
FIG. 14 is a sectional view taken along line E—E of FIG. 12.

FIG. 12 is a front view showing a window and door viewed from an outside, in which an outdoor window leaf is replaced with a fixed window FIGS. 13 and 14 are sectional views taken along lines D—D and E—E of FIG. 12.

In FIG. 13, the window leaf lower member 3 is replaced with an outdoor window leaf 4*a* in such a manner that a fixed window 40 is mounted into an outdoor rail filling device groove 39, and finished up with a gasket 401 and a supporting member 402.

In FIG. 14, a window frame upper member 8 is replaced with an outdoor window leaf 9*a* in such a manner that a fixed window 40 is mounted into an indoor supporting groove 83 and finished up with a gasket 401.

Figure 15:
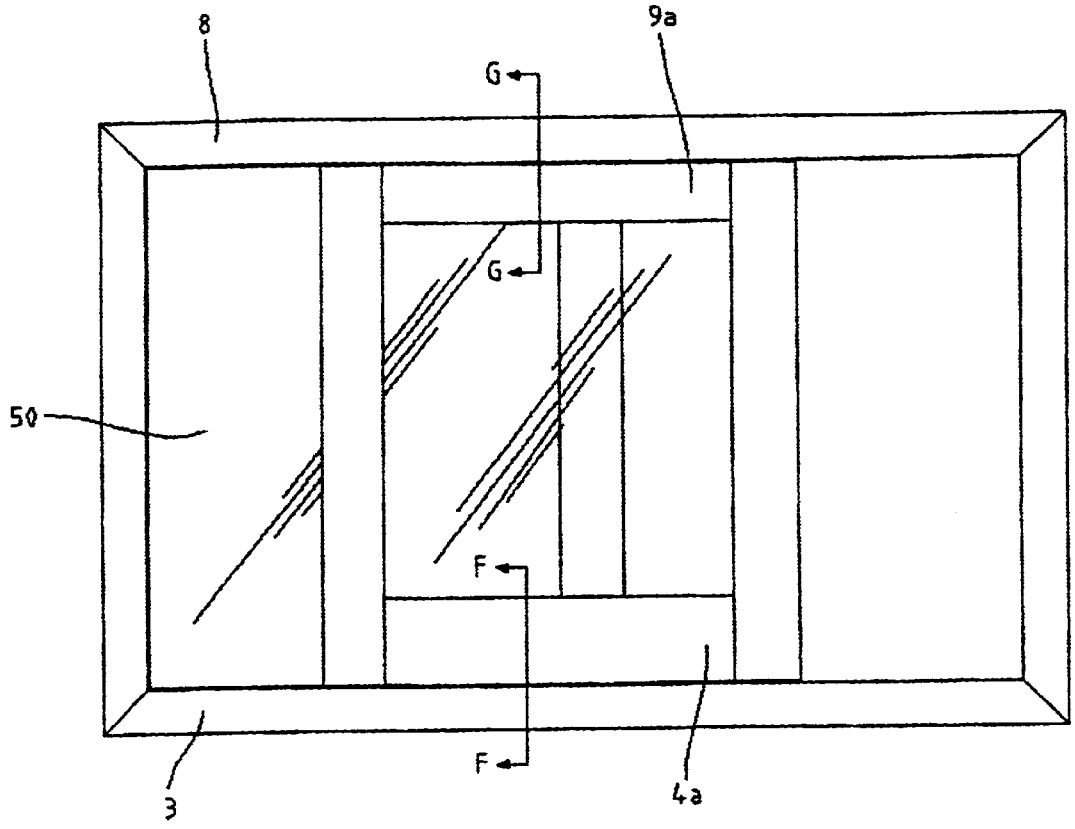
FIG. 15 is a front view showing a window and door viewed from an outside, in which an indoor window leaf (or door leaf) is replaced with a fixed window (or fixed door)
Figure 16:
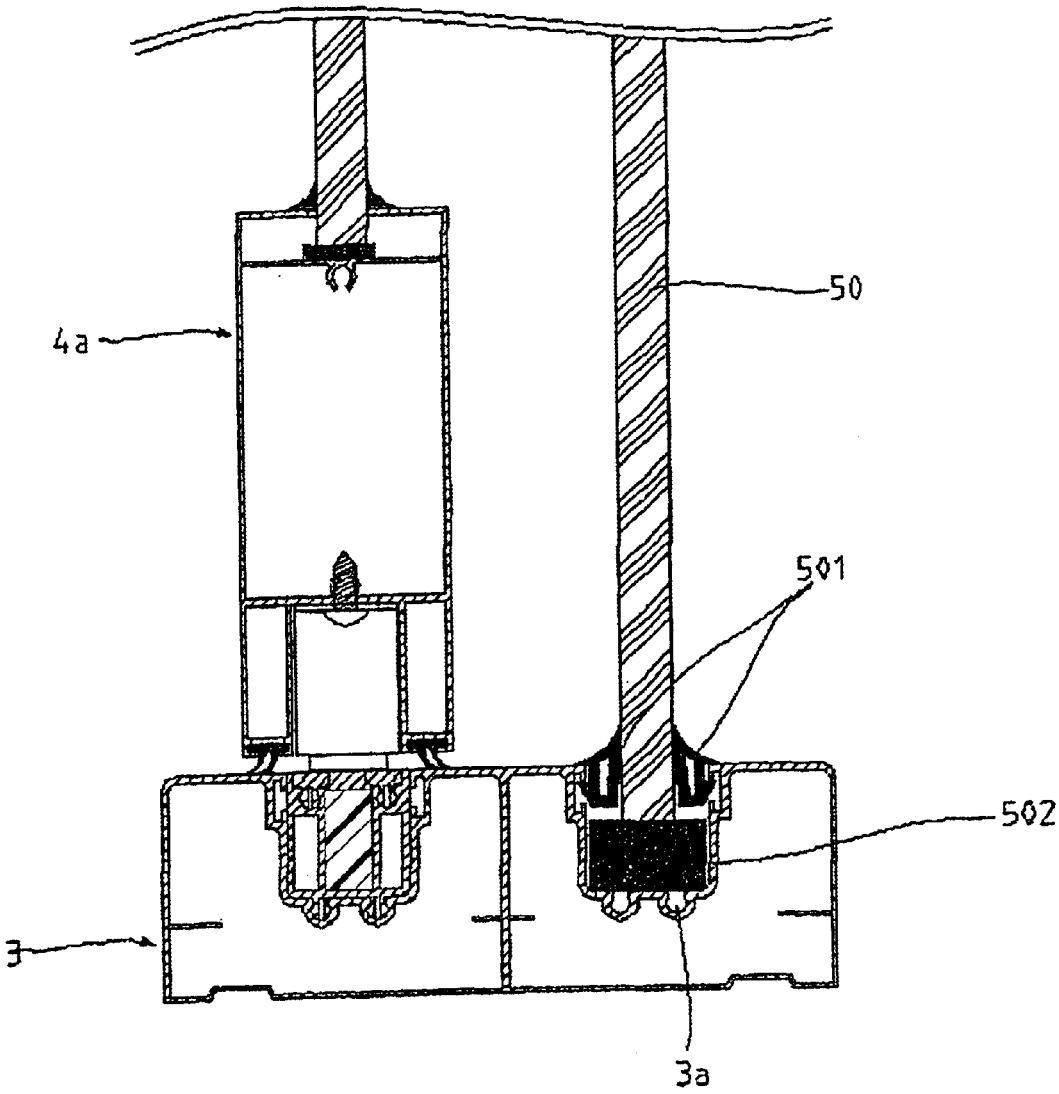
FIG. 16 is a sectional view taken along line F—F of FIG. 15.
Figure 17:
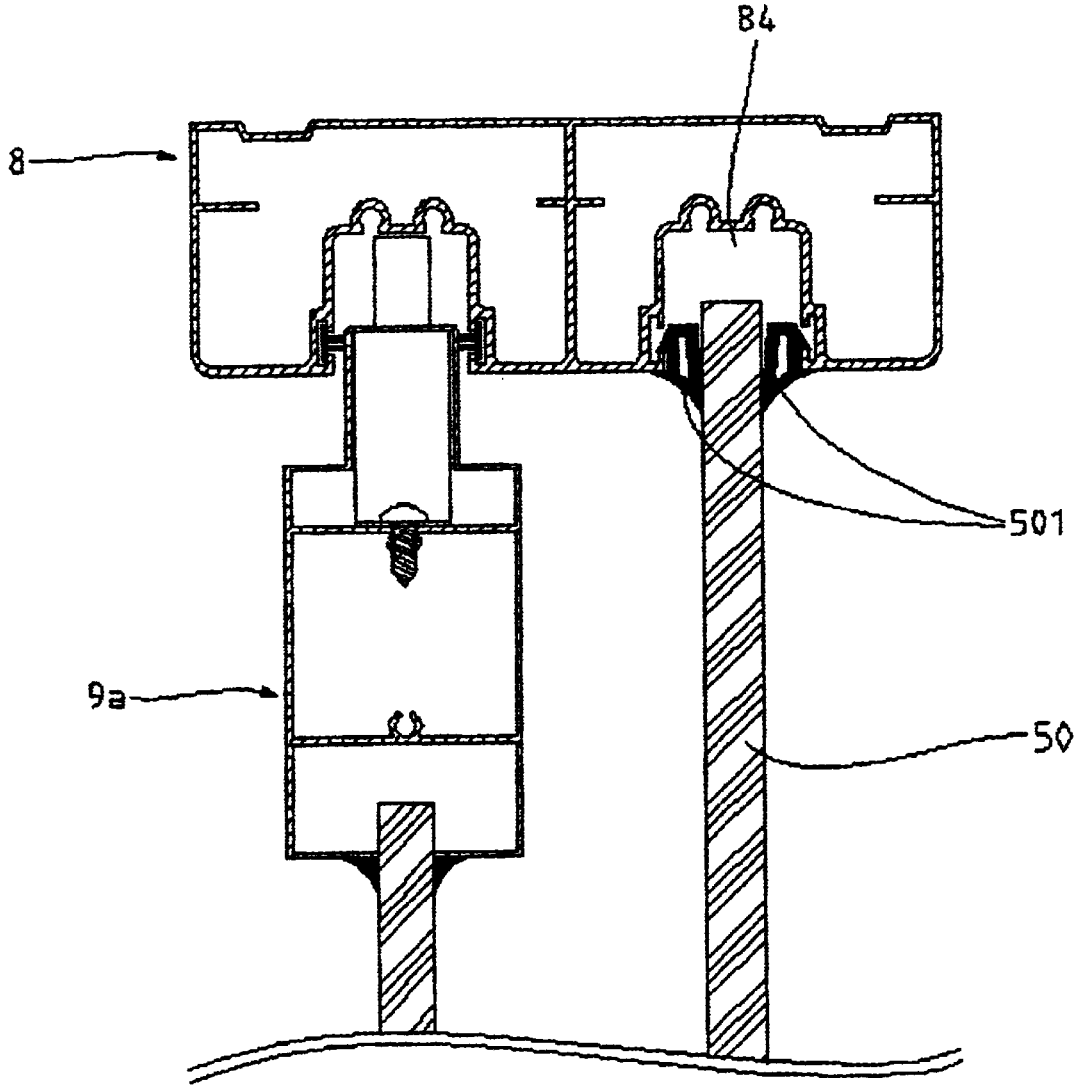
FIG. 17 is a sectional view taken along line G—G of FIG. 15.

FIG. 15 is a front view showing a window and door viewed from an outside, in which an indoor window leaf is replaced with a fixed window. FIGS. 16 and 17 are sectional views taken along lines F—F and G—G of FIG. 15.

In FIG. 16, the window leaf lower member 3 is replaced with an indoor window leaf 4*b* in such a manner that a fixed window 50 is mounted into an indoor rail filling device groove 3*a* and finished up with gaskets 501 and a supporting member 502.

FIG. 17, a window frame upper member 8 is replaced with an indoor window leaf 9*b* in such a manner that a fixed window 50 is mounted into an indoor supporting groove 84 and finished up with gaskets 501 and 501.

Figure 18:
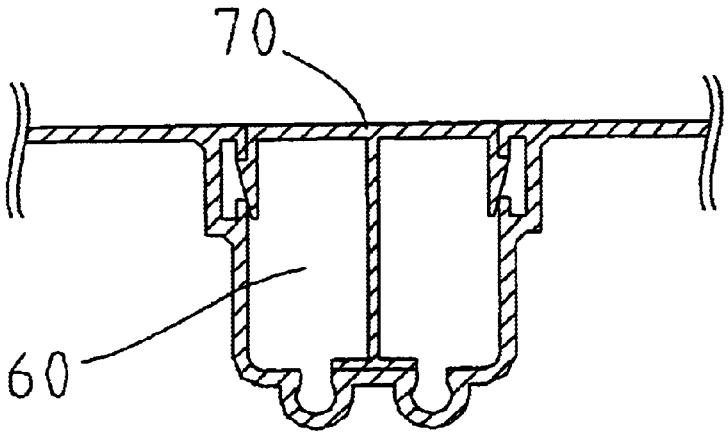
FIG. 18 is an installation view of a fixed window (or fixed door) groove cover.

In FIG. 18, a groove 50 in a portion having no fixed windows 40 and 50 in FIGS. 13, 14, 16 and 17 is finished up with a fixed window groove cover 70.

INDUSTRIAL APPLICABILITY

As aforementioned, the sliding window and door system according to the present invention has the following advantages.

In the related art, a drainage outlet is provided in a rail to drain out rainwater because the rail is exposed. However, in the present invention, rainwater is guided to the outside on the surface. Accordingly, the rainwater is essentially prevented from being induced into the indoor. Also, since no separate drainage outlet is provided, air tightness, water tightness, and thermal insulation can be improved. Since the process steps can be reduced, the productivity can be improved.

In the upper structure, a detachment prevention structure is applied, so that vertical movement of the window leaf in the upper and lower directions can be avoided. Accordingly, safety can be ensured by solving the problem related to detachment due to strong wind or manipulation.

The related art window and door system has a problem in that movement and noise of the window leaf occur and a window frame should be exchanged with another one if the rail is abraded. However, in the present invention, a rail filling system is only to be exchanged with another one if the rail is abraded. Accordingly, the production cost and time can be reduced.

Furthermore, in the present inventor, since an even structure not an uneven structure is formed, pile of dust is avoided and it is easy to maintain cleaning state. Appearance such as an even type and a frame type can be improved depending on taste and function. Thus, a window and door system of high quality can be obtained.

While the present invention has been described and illustrated herein with reference to the preferred embodiments thereof, it will be apparent to those skilled in the that various modifications and variations can be made therein without departing from the spirit and scope of the invention. Thus, it is intended that the present invention covers the modifications and variations of this invention that come within the scope of the appended claims and their equivalents.

What is claimed is:

1. A sliding closure system comprising:

an elongate frame lower member including a frame base member, a surface member formed with a longitudinal groove, and a groove filling device in the longitudinal groove, the groove filling device comprising an elastic member and an elongate filling member above the elastic member, a slidable leaf lower member, and a height control roller attached to the slidable leaf lower member, the height control roller having a projection that is received in the longitudinal groove for guiding the slidable leaf lower member longitudinally of the frame lower member, and wherein the groove filling device further comprises two elongate roller supporting members at opposite respective sides of the longitudinal groove and separated by an elongate space, and the elastic member urges the elongate filling member into engagement with a generally downwardly facing surface of at least one of said two elongate roller supporting members.

2. A sliding closure system according to claim 1, wherein the roller supporting members and the elongate filling member are configured to limit upward movement of the elongate filling member relative to the surface member.

3. A sliding closure system according to claim 1, wherein the groove filling device comprises a groove filling device base member and said two elongate roller supporting members are secured to the groove filling device base member at said opposite respective sides of the longitudinal groove, the groove filling device base member and the two roller supporting members define said elongate space, the elastic member and the elongate filling member are located in the elongate space, and the elastic member urges the elongate filling member upwards in the elongate space.

4. A sliding closure system according to claim 1, further comprising sealing elements carried by the leaf lower member and in sliding engagement with the frame lower member for resisting penetration of air between the leaf lower member and the frame lower member.

5. A sliding closure system according to claim 1, wherein the surface member of the frame lower member has first and second longitudinal regions, the first longitudinal region is formed with said longitudinal groove, the second longitudinal region is formed with a second longitudinal groove that is parallel to the longitudinal groove formed in the first longitudinal region.

6. A sliding closure system according to claim 5, wherein the system further comprises a second slidable leaf lower member and a second height control roller attached to the second slidable leaf lower member, and the second height control roller has a projection that is received in the second longitudinal groove for guiding the second leaf lower member longitudinally of the frame lower member.

7. A sliding closure system according to claim 6, wherein the first and second longitudinal regions of the surface member of the frame lower member are at different heights respectively with respect to the frame base member and the second slidable leaf lower member has a greater vertical extent than the vertical extent of the first slidable leaf lower member.

8. A sliding closure system according to claim 7, wherein the difference between said heights is substantially equal to the difference between the vertical extents of the slidable leaf lower members.

9. A sliding closure system according to claim 5, wherein the second longitudinal groove is composed of first and second length segments, and the system further comprises a fixed panel fitted in the first length segment of the second longitudinal groove and a groove cover fitted in the second length segment of the second longitudinal groove.

10. A sliding closure system according to claim 1, further comprising:

an elongate frame upper member formed with a longitudinal groove, a slidable leaf upper member having an upper insertion portion that projects into the longitudinal groove of the frame upper member.

11. A sliding closure system according to claim 10, comprising a retaining roller attached to the upper insertion portion of the slidable leaf upper member and projecting into the longitudinal groove of the frame upper member to limit upward movement of a slidable leaf upper member relative to the frame upper member.

12. A sliding closure system according to claim 10, wherein the frame upper member comprises a base member and a surface member, the surface member of the frame upper member has first and second longitudinal regions, the first longitudinal region of the surface member of the frame upper member is formed with said longitudinal groove of said frame upper member, the second longitudinal region is formed with a second longitudinal groove, and the longitudinal grooves of said longitudinal regions are substantially parallel.

13. A sliding closure system according to claim 12, wherein the first and second longitudinal regions of the surface member of the frame upper member are at different heights respectively with respect to the base member of the frame upper member and the second slidable leaf upper member has a smaller vertical extent than the vertical extent of the first slidable leaf upper member.

14. A sliding closure system according to claim 12, wherein the system further comprises a second slidable leaf upper member having an upper insertion portion that projects into the second longitudinal groove of the frame upper member.

15. A sliding closure system according to claim 12, wherein the second longitudinal groove of the frame upper member is composed of first and second length segments, and the system further comprises a fixed panel fitted in the first length segment and a groove cover fitted in the second length segment.

16. A sliding closure system comprising:

a frame comprising an elongate frame lower member, wherein the frame lower member includes a frame base member, a surface member formed with a longitudinal groove, and a groove filling device in the longitudinal groove, the groove filling device comprising an elastic member and an elongate filling member above the elastic member, a slidable leaf including a lower member, and a height control roller attached to the slidable leaf lower member, the height control roller having a projection that is received in the longitudinal groove for guiding the slidable leaf lower member longitudinally of the frame lower member, and wherein the groove filling device further comprises two elongate roller supporting members at opposite respective sides of the longitudinal groove and separated by an elongate space, and the elastic member urges the elongate filling member into engagement with a generally downwardly facing surface of at least one of said two elongate roller supporting members.

17. A sliding closure system according to claim 16, wherein the frame comprises an elongate frame upper member formed with a longitudinal groove and the slidable leaf includes a slidable leaf upper member having an upper insertion portion that projects into the longitudinal groove of the frame upper member.

* * * * *